US011445805B2

(12) United States Patent
Becht

(10) Patent No.: US 11,445,805 B2
(45) Date of Patent: Sep. 20, 2022

(54) FOOTWEAR TRANSPORTATION DEVICE

(71) Applicant: Mark Becht, Bangor, PA (US)

(72) Inventor: Mark Becht, Bangor, PA (US)

( * ) Notice: Subject to any disclaimer, the term of this patent is extended or adjusted under 35 U.S.C. 154(b) by 0 days.

(21) Appl. No.: 16/275,281

(22) Filed: Feb. 13, 2019

(65) Prior Publication Data

US 2019/0246774 A1 Aug. 15, 2019

Related U.S. Application Data

(60) Provisional application No. 62/629,906, filed on Feb. 13, 2018.

(51) Int. Cl.

| | |
|---|---|
| ***A45F 3/00*** | (2006.01) |
| ***A42B 1/006*** | (2021.01) |
| ***A45C 3/12*** | (2006.01) |
| *A42B 1/04* | (2021.01) |
| *A47G 25/00* | (2006.01) |

(52) U.S. Cl.

CPC ..... *A45F 3/00* (2013.01); *A42B 1/006* (2013.01); *A45C 3/12* (2013.01); *A42B 1/04* (2013.01); *A45F 2003/002* (2013.01); *A47G 25/005* (2013.01)

(58) Field of Classification Search

CPC ... A43B 5/0425; A45C 3/12; A45F 2003/002; A45F 2003/003; A45F 2005/006; A45F 3/14

USPC ..... D3/317; 224/257–264, 600–626

See application file for complete search history.

(56) References Cited

U.S. PATENT DOCUMENTS

| | | | | |
|---|---|---|---|---|
| 4,085,873 | A * | 4/1978 | Schweitzer | A45C 7/0077 224/153 |
| D339,680 | S * | 9/1993 | Hodges, Jr. | D2/912 |
| 5,513,787 | A * | 5/1996 | Reed | A45C 3/12 224/602 |
| 6,029,847 | A * | 2/2000 | Mahoney, Jr. | A45C 11/20 220/592.24 |
| 2007/0039841 | A1* | 2/2007 | Deloatch-Ratliff | A45C 3/12 206/278 |
| 2007/0272570 | A1* | 11/2007 | Brooks | A43B 5/0425 206/315.9 |

* cited by examiner

*Primary Examiner* — Scott T McNurlen

(57) ABSTRACT

A footwear transportation device is an apparatus used to contain, protect, and transport various shoes, sandals, sneakers, and other such footwear. The apparatus is also configured to hang comfortably around a user's neck or over a user's shoulder for carrying ease. The apparatus includes a storage pouch, a hood, a first shoe-supporting mechanism, and a second shoe-supporting mechanism. The storage pouch allows for storage of items. The hood is an enclosure generally used to cover the head of a user. The first shoe-supporting mechanism and the second shoe-supporting mechanism are units allowing for containment and support of one of a pair of shoes each. The first shoe-supporting mechanism and the second shoe-supporting mechanism each comprise a flexible line and a shoe pouch. The flexible line is a connector made of elastic material. The shoe pouch is a storage unit which allows for secure containment of a shoe or other footwear.

12 Claims, 5 Drawing Sheets

FOOTWEAR TRANSPORTATION DEVICE

The current application claims a priority to the U.S. Provisional Patent application Ser. No. 62/629,906 filed on Feb. 13, 2018.

FIELD OF THE INVENTION

The present invention generally relates to footwear care. More specifically, the present invention relates to a footwear transportation device that protects various shoes, sandals, sneakers, and other footwear from physical or aesthetic damage.

BACKGROUND OF THE INVENTION

Sneaker culture has risen in mainstream popularity over the last several decades. It has become common for people of all ages, genders, and ethnicities to have their own collections of various footwear, and it is common for many to proudly display these shoes in public. Events and occasions in front of cameras allow the wearer to document their impressive shoe-collecting prowess and express their style expertise in a fashionable and trendy manner.

Unfortunately, the financial and personal value of many of these shoes often makes the risk of wearing or carrying such shoes a risky proposition. It is always a challenge for users to keep their sneakers clean and safe while carrying or wearing the sneakers. For example, it is common for a user to accidently step into mud or a puddle and get a shoe dirty, which can potentially damage the design or body of the shoe. Such a sudden deterioration of the value of one shoe can effectively ruin the pair of shoes. Thus, most users prefer to not wear their sneakers and leave them at home, sometimes even leaving the sneakers on their original box where they cannot even be seen casually. The most common current solution for this problem is for users to carry a bag, such as a gym bag, in order to transport a stylish or expensive pair of sneakers without risking their damage in transit. However, most of the currently available bags are uncomfortable to carry around and completely hide the sneakers contained within, which prevents the user from displaying their sneakers. What is needed is a portable device which allows the user to comfortably carry a pair of shoes around the neck.

The present invention addresses this issue. The footwear transportation device provides users with a fashionable way to transport footwear without the risk of the contained shoes becoming damaged or dirty. A hood is stored within a comfortable, preferably gel-lined enclosure, allowing the user to choose to cover and heat the user's head or store the hood for another time. An elastic cord provides a mechanism for comfortably carrying the shoes that invokes imagery of a pair of shoes being thrown over a telephone line. The individual footwear holders may be made of transparent material, which allows the user to display the shoes without wearing them and risking the footwear integrity. The present invention is arranged to be comfortable and convenient enough that the user is able to run, bike, and perform other exercise movements while wearing the present invention.

DETAILED DESCRIPTION OF THE INVENTION

All illustrations of the drawings are for the purpose of describing selected versions of the present invention and are not intended to limit the scope of the present invention.

Figure 1:
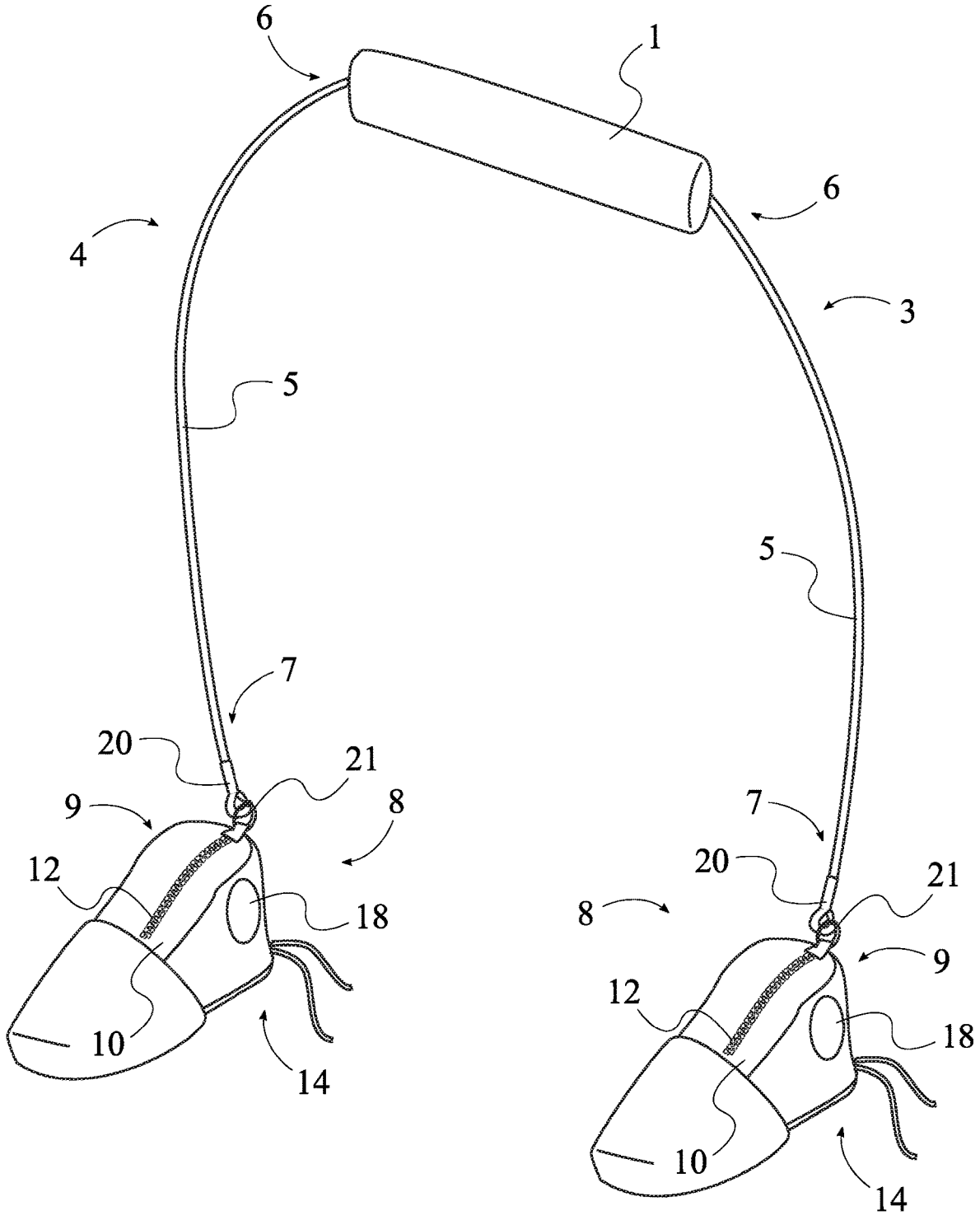
FIG. 1 is a front-right perspective view of the present invention.

The present invention is a footwear transportation device that is used to contain, protect, and transport various shoes, sandals, sneakers, and other such footwear. The present invention is also configured to hang comfortably around a user's neck or over a user's shoulder for carrying ease. The present invention comprises a storage pouch 1, a hood 2, a first shoe-supporting mechanism 3, and a second shoe-supporting mechanism 4, as seen in FIG. 1. The storage pouch 1 is a flexible, preferably waterproof container which allows for storage of items. The storage pouch 1 may be opened or closed via any of zippers, hook-and-loop fasteners, or other such closure mechanisms. The storage pouch 1 may further be lined with any of a variety of comfort-enhancing gels or soft polymers. In a further exemplary embodiment, the storage pouch 1 is made of material that can be written upon, thus allowing the user to decorate the storage pouch 1 as desired The hood 2 is a fabric or cloth enclosure which is generally used to cover the head of a user. The first shoe-supporting mechanism 3 is a unit which allows for containment and support of one of a pair of shoes; similarly, the second shoe-supporting mechanism 4 allows for containment and support of the opposing shoe. The first shoe-supporting mechanism 3 and the second shoe-supporting mechanism 4 each comprise a flexible line 5, a shoe pouch 8, and a tightening mechanism 14. The flexible line 5 is a connector that is preferably made of elastic material. The shoe pouch 8 is a preferably waterproof storage unit which allows for secure containment and protection of a shoe or other footwear. In an exemplary embodiment, the shoe pouch 8 is made of transparent material, thus allowing the user to display contained footwear during footwear transportation. In a further exemplary embodiment, the shoe pouch 8 is made of fabric material that can be written upon, thus allowing the user to decorate the shoe pouch 8 as desired. The tightening mechanism 14 is a unit which allows for adjustment of the size of the shoe pouch 8. The flexible line 5 comprises a proximal line end 6 and a distal line end 7. The proximal line end 6 is the section of the flexible line 5 closer to the storage pouch 1. The distal line end 7 is the section of the flexible line 5 further from the storage pouch 1.

Figure 2:
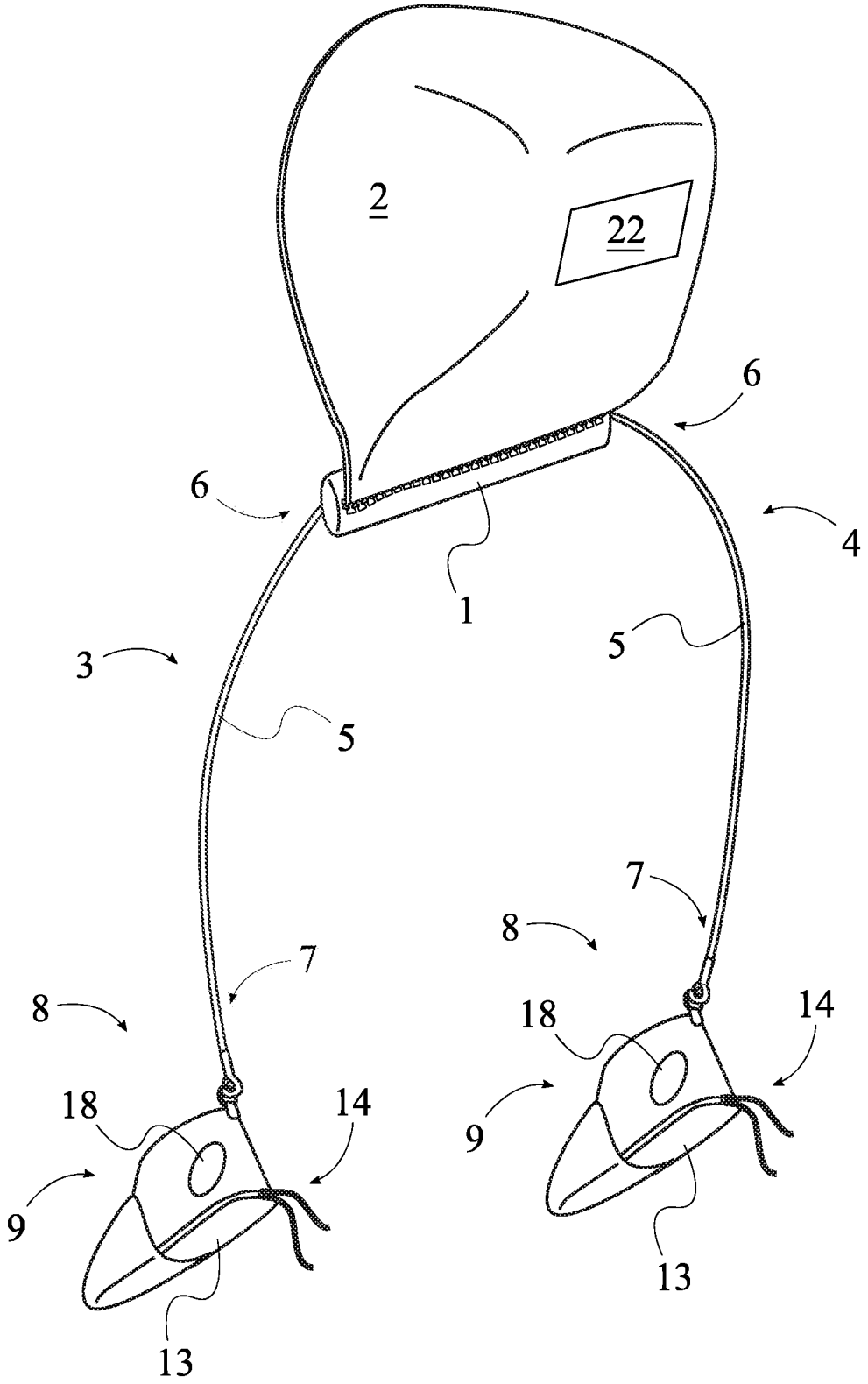
FIG. 2 is a back-right perspective view of the present invention with the hood open.

The general configuration of the aforementioned components allows the present invention to efficiently and effectively contain and carry various footwear. The hood 2 is operatively coupled into the storage pouch 1, wherein the storage pouch 1 is used to selectively deploy the hood 2, as seen in FIG. 2. This arrangement allows the user to utilize the hood 2 as a garment for warmth and protection of the user's head while carrying a pair of shoes. The proximal line end 6 of the first shoe-supporting mechanism 3 is connected adjacent to the storage pouch 1. Further, the proximal line end 6 of the second shoe-supporting mechanism 4 is connected adjacent to the storage pouch 1, opposite to the proximal line end 6 of the first shoe-supporting mechanism 3. In this way, the first shoe-supporting mechanism 3 and the second shoe-supporting mechanism 4 are positioned appropriately relative to the storage pouch 1 by the proximal line end 6. The distal line end 7 is pivotably connected to the shoe pouch 8. This arrangement allows the shoe pouch 8 to swivel and rotate relative to the distal line end 7. The tightening mechanism 14 is operatively integrated into the shoe pouch 8, wherein the tightening mechanism 14 is used to restrict contents of the shoe pouch 8. In this way, the tightening mechanism 14 can securely hold the footwear in place within the shoe pouch 8.

Figure 3:
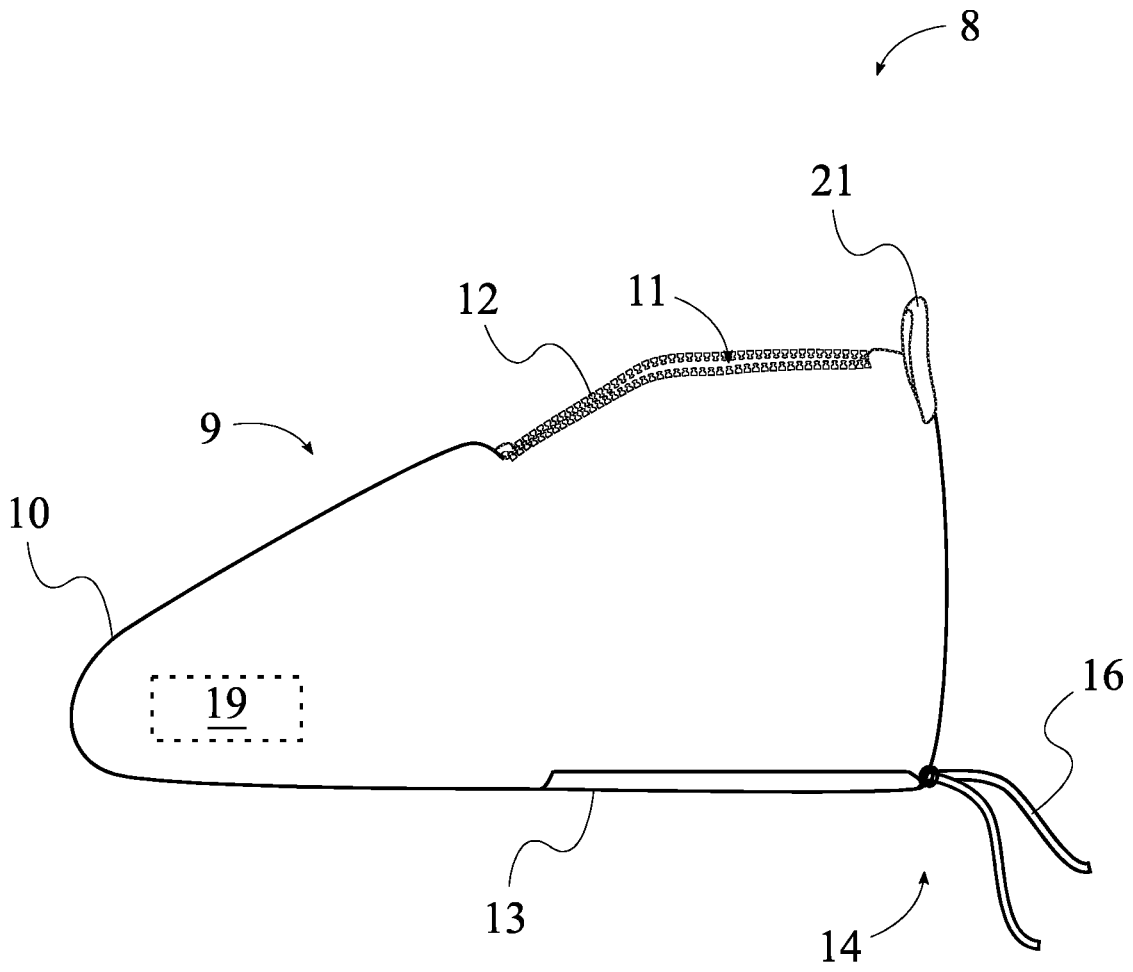
FIG. 3 is a side schematic view of a shoe pouch of the present invention.

The shoe pouch 8 of the first shoe-supporting mechanism 3 and the second shoe-supporting mechanism 4 must be configured to receive footwear of various sizes and shapes. To this end, the shoe pouch 8 comprises a shoe-shaped cover 9, a shoe opening 11, a fastener 12, and a sole 13, as seen in FIG. 3. The shoe-shaped cover 9 is a protective unit shaped to hold a variety of footwear. The shoe opening 11 is a space into which various footwear may be inserted or exited out of the shoe-shaped cover 9. The fastener 12 is a unit which enables access to the shoe opening 11. In a preferred embodiment, the fastener 12 is a zipper or a hook-and-loop fastener. The sole 13 is a segment of the shoe pouch 8 that contacts the bottom of the shoe. The shoe-shaped cover 9 comprises a tongue portion 10. The tongue portion 10 is a segment of the shoe-shaped cover 9 which protects the toe and tongue segments of a contained shoe. The shoe opening 11 is integrated into the tongue portion 10. This arrangement positions the shoe opening 11 so that footwear can be inserted into or removed from an easily-accessible part of the shoe-shaped cover 9. The shoe opening 11 and the sole 13 are positioned opposite to each other about the shoe-shaped cover 9. In this way, inserted shoes can be intuitively positioned for storage, display, and removal. The fastener 12 is operatively integrated into the shoe opening 11, wherein the fastener 12 is used to toggle access to the shoe opening 11. This arrangement results in the fastener 12 being engaged to secure footwear within the shoe opening 11, or the fastener 12 being disengaged to remove the footwear through the shoe opening 11.

Figure 4:
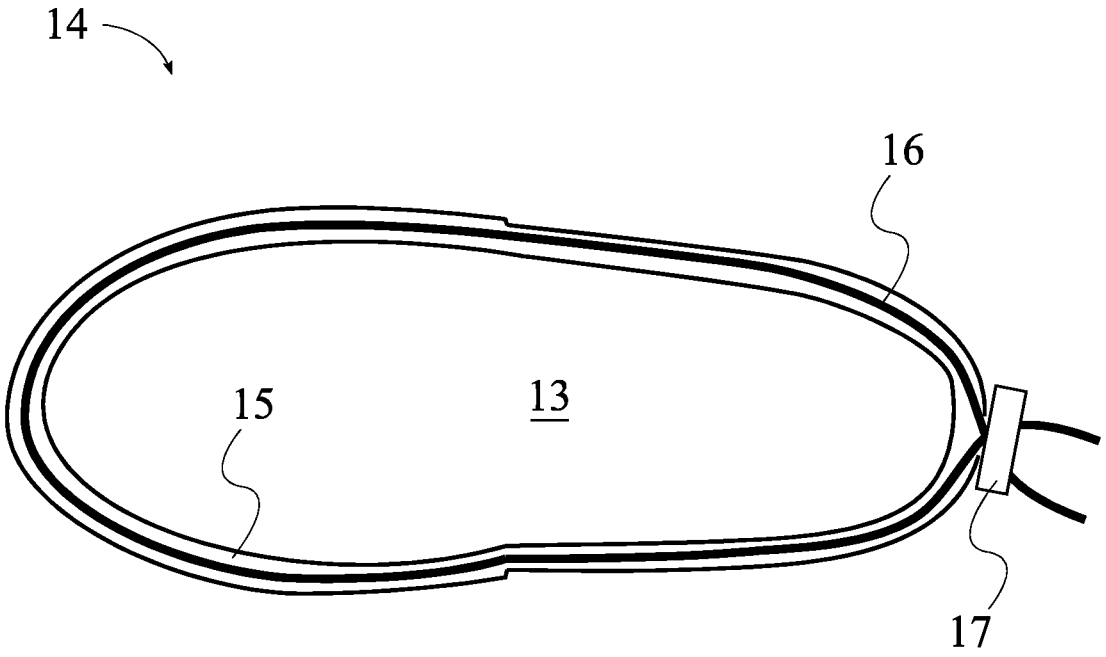
FIG. 4 is a bottom schematic view of the tightening mechanism of the present invention.

The shoe pouch 8 may need to adjust in order to more precisely accommodate a contained piece of footwear. To this end, the tightening mechanism 14 comprises a string sleeve 15, a drawstring 16, and a slide stopper 17, as seen in FIG. 4. The string sleeve 15 is a tubular lining that allows for support and containment of the drawstring 16. The drawstring 16 is a flexible unit that allows for control over the size of the string sleeve 15. The slide stopper 17 is a rigid unit which controls the loop size of the drawstring 16. The string sleeve 15 is peripherally connected to the sole 13. This arrangement allows the string sleeve 15 to adjust the tension felt by the sole 13. The drawstring 16 traverses through the string sleeve 15. In this way, the drawstring 16 is positioned to tighten the string sleeve 15. The slide stopper 17 is externally positioned to the string sleeve 15. This allows the user to access the slide stopper 17. Furthermore, the slide stopper 17 is slidably engaged along the drawstring 16. This arrangement allows the user to tighten the drawstring 16 by pulling the drawstring 16 and securing the drawstring 16 in position with the slide stopper 17.

The user of the present invention may desire to stand out in a crowd or may further benefit from enhanced visibility at night. To this end, the first shoe-supporting mechanism 3 and the second shoe-supporting mechanism 4 each comprise at least one first reflector 18, as seen in FIG. 2. The at least one first reflector 18 is a unit that reflects incident light. The at least one first reflector 18 is externally adhered to the shoe pouch 8. This arrangement allows the shoe pouch 8 to attract increased attention to passersby. The user may also desire to increase visibility near the head, neck, or shoulder regions that are covered by the storage pouch 1 during use. The present invention further comprises at least one second reflector 22, as seen in FIG. 2. The at least one second reflector 22 also reflects incident light. The at least one second reflector 22 is externally adhered to the storage pouch 1. This arrangement allows the at least one second reflector 22 to increase the visibility of the storage pouch 1. In an exemplary embodiment, the at least one second reflector 22 is connected to the hood 2 in order to increase the visibility of the hood 2.

Footwear that has been worn often retains the unpleasant odor of the user's feet. To alleviate this issue, the first shoe-supporting mechanism 3 and the second shoe-supporting mechanism 4 each comprise at least one deodorizing device 19, as seen in FIG. 3. The at least one deodorizing device 19 is a unit, preferably a scent-infused strip, that disperses pleasant smells throughout the shoe pouch 8. The at least one deodorizing device 19 is positioned within the shoe pouch 8. In this way, the at least one deodorizing device 19 is optimally positioned to address the issue of footwear smell.

Figure 5:
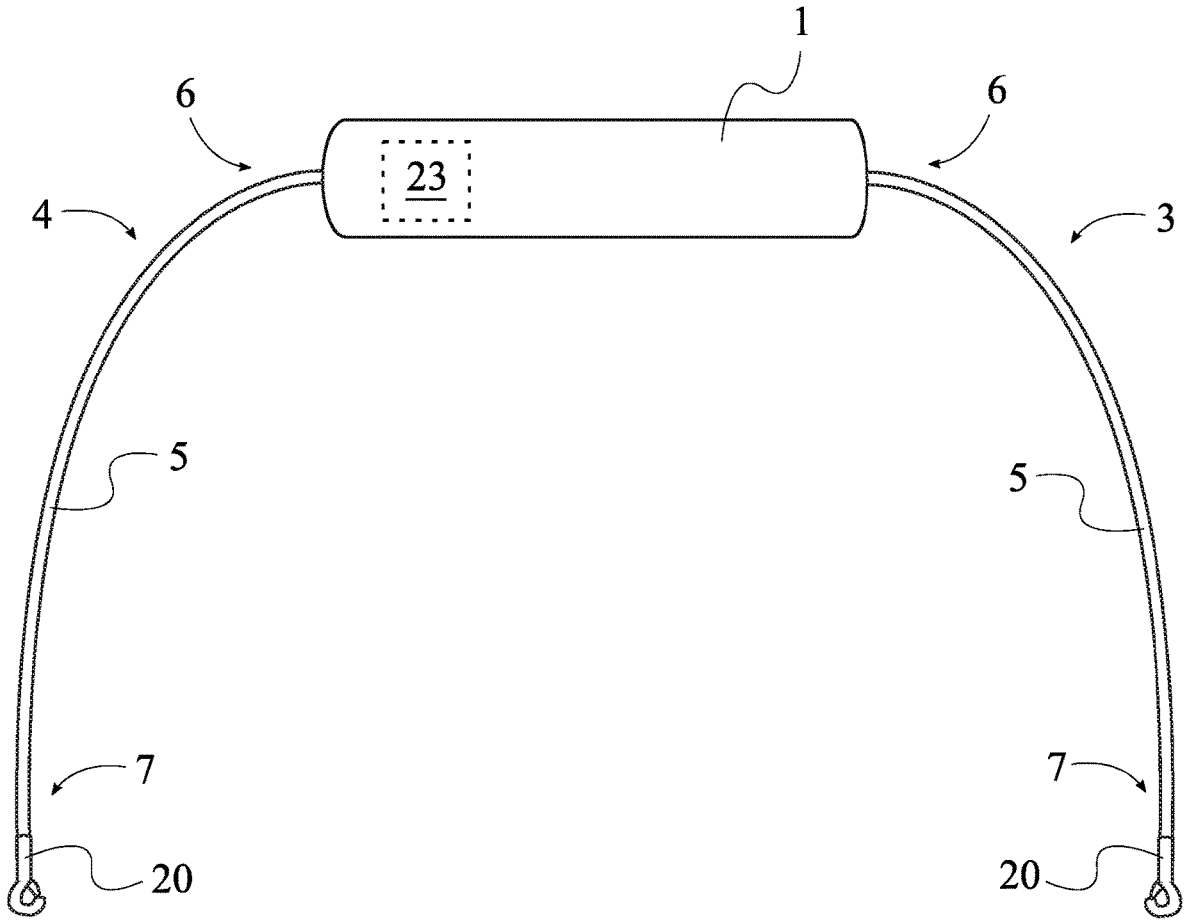
FIG. 5 is a front view of the storage pouch of the present invention.

The user may desire to store personal items within the present invention. To this end, the present invention comprises at least one pocket 23, as seen in FIG. 5. The at least one pocket 23 is an opening that allows for containment of otherwise-loose items, such as a wallet, phone, credit cards, identification cards, and the like. The at least one pocket 23 is internally connected within the storage pouch 1. This arrangement allows the at least one pocket 23 to hold items securely inside the storage pouch 1.

The shoe pouch 8 may need to detach or separate from the distal line end 7. In order to accomplish this, the first shoe-supporting mechanism 3 and the second shoe-supporting mechanism 4 each comprise a shackle 20 and a heel loop 21. The shackle 20 is a rigid connector that joins to the heel loop 21, as seen in FIG. 1. The shackle 20 can be, but is not limited to, a carabiner, a spring clasp, a lobster claw clasp, or a variety of other couplers. The heel loop 21 is a generally flexible connector that provides a connection mechanism for the shackle 20. The heel loop 21 is externally mounted to the shoe pouch 8. This arrangement allows the shackle 20 to connect to the heel portion of the shoe pouch 8. The shackle 20 is connected onto the distal line end 7. In this way, the shackle 20 is positioned to join the distal line end 7 to the shoe pouch 8. The shackle 20 is pivotably linked to the heel loop 21. This arrangement allows the shoe pouch 8 to swivel relative to the distal line end 7 when the shackle 20 is connected to the heel loop 21.

Although the invention has been explained in relation to its preferred embodiment, it is to be understood that many other possible modifications and variations can be made without departing from the spirit and scope of the invention as hereinafter claimed.

What is claimed is:

1. A footwear transportation device comprises:

a storage pouch; a hood;

a first shoe-supporting mechanism;

a second shoe-supporting mechanism;

the first shoe-supporting mechanism and the second shoe-supporting mechanism each comprise a flexible line, a shoe pouch, and a tightening mechanism;

the flexible line comprises a proximal line end and a distal line end; the hood being operatively coupled into the storage pouch, wherein the storage pouch is used to selectively deploy the hood;

the proximal line end of the first shoe-supporting mechanism being connected adjacent to the storage pouch;

the proximal line end of the second shoe-supporting mechanism being connected adjacent to the storage pouch, opposite to the proximal line end of the first shoe-supporting mechanism;

the distal line end being pivotably connected to the shoe pouch; and the tightening mechanism being operatively integrated into the shoe pouch, wherein the tightening mechanism is used to adjust the size of the shoe pouch; and the shoe pouch comprises a shoe-shaped cover, a sole, a tongue portion, and a shoe opening, the tongue portion being a segment of the shoe-shaped cover opposite the sole, and the shoe opening being integrated into the tongue portion, wherein the tightening mechanism comprises a string sleeve, a drawstring, and a slide stopper;

the string sleeve being peripherally connected to the sole; the drawstring traversing through the string sleeve; and the slide stopper being externally positioned to the string sleeve; and the slide stopper being slidably engaged along the drawstring, the size of the shoe pouch being adjustable by slidably engaging the slide stopper.

2. The footwear transportation device as claimed in claim 1 comprises: the first shoe-supporting mechanism and the second shoe-supporting mechanism each comprise at least one first reflector; and the at least one first reflector being externally adhered to the shoe pouch.

3. The footwear transportation device as claimed in claim 1 comprises: at least one second reflector; and the at least one second reflector being externally adhered to the storage pouch.

4. The footwear transportation device as claimed in claim 1 comprises: the first shoe-supporting mechanism and the second shoe-supporting mechanism each comprise at least one deodorizing device; and the at least one deodorizing device being positioned within the shoe pouch.

5. The footwear transportation device as claimed in claim 1 comprises:

at least one pocket; and the at least one pocket being internally connected within the storage pouch.

6. The footwear transportation device as claimed in claim 1 comprises:

the first shoe-supporting mechanism and the second shoe-supporting mechanism each comprise a shackle and a heel loop;

the heel loop being externally mounted to the shoe pouch; the shackle being connected onto the distal line end; and the shackle being pivotably linked to the heel loop.

7. A footwear transportation device comprises:

a storage pouch;

a hood;

a first shoe-supporting mechanism;

a second shoe-supporting mechanism;

the first shoe-supporting mechanism and the second shoe-supporting mechanism each comprise a flexible line, a shoe pouch, and a tightening mechanism;

the flexible line comprises a proximal line end and a distal line end; the shoe pouch comprises a shoe-shaped cover, a shoe opening, a fastener, and a sole;

the shoe-shaped cover comprises a substantially flat tongue portion;

the hood being operatively coupled into the storage pouch, wherein the storage pouch is used to selectively deploy the hood;

the proximal line end of the first shoe-supporting mechanism being connected adjacent to the storage pouch;

the proximal line end of the second shoe-supporting mechanism being connected adjacent to the storage pouch, opposite to the proximal line end of the first shoe-supporting mechanism;

the distal line end being pivotably connected to the shoe pouch;

the tightening mechanism being operatively integrated into the shoe pouch, wherein the tightening mechanism is used to adjust the size of the shoe pouch;

the shoe opening being integrated into the tongue portion;

the tongue portion and the sole being positioned opposite to each other about the shoe-shaped cover; and the fastener being operatively integrated into the shoe opening, wherein the fastener is used to toggle access to the shoe opening, wherein the tightening mechanism comprises a string sleeve, a drawstring, and a slide stopper;

the string sleeve being peripherally connected to the sole;

the drawstring traversing through the string sleeve; and the slide stopper being externally positioned to the string sleeve; and the slide stopper being slidably engaged along the drawstring.

8. The footwear transportation device as claimed in claim 7 comprises:

the first shoe-supporting mechanism and the second shoe-supporting mechanism each comprise at least one first reflector; and the at least one first reflector being externally adhered to the shoe pouch.

9. The footwear transportation device as claimed in claim 7 comprises:

at least one second reflector; and the at least one second reflector being externally adhered to the storage pouch.

10. The footwear transportation device as claimed in claim 7 comprises:

the first shoe-supporting mechanism and the second shoe-supporting mechanism each comprise at least one deodorizing device; and the at least one deodorizing device being positioned within the shoe pouch.

11. The footwear transportation device as claimed in claim 7 comprises:

at least one pocket; and the at least one pocket being internally connected within the storage pouch.

12. The footwear transportation device as claimed in claim 7 comprises:

the first shoe-supporting mechanism and the second shoe-supporting mechanism each comprise a shackle and a heel loop;

the heel loop being externally mounted to the shoe pouch; the shackle being connected onto the distal line end; and the shackle being pivotably linked to the heel loop.

* * * * *